US007525522B2

(12) United States Patent
Iida et al.

(10) Patent No.: US 7,525,522 B2
(45) Date of Patent: Apr. 28, 2009

(54) DISPLAY APPARATUS

(75) Inventors: Yukihito Iida, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/938,947

(22) Filed: Nov. 13, 2007

(65) Prior Publication Data

US 2008/0111774 A1 May 15, 2008

(30) Foreign Application Priority Data

Nov. 13, 2006 (JP) ..... 2006-306125

(51) Int. Cl.
*G09G 3/30* (2006.01)

(52) U.S. Cl. ..... 345/76; 345/82; 345/84

(58) Field of Classification Search ..... 345/36, 345/38–39, 45, 76–79, 82–84, 87–88, 90–95, 345/98–100, 204–205, 210–214; 340/815.45; 315/169.1, 169.3

See application file for complete search history.

(56) References Cited

U.S. PATENT DOCUMENTS 6,229,506 B1 * 5/2001 Dawson et al. ..... 345/82
7,224,334 B2 * 5/2007 Choi et al. ..... 345/82
7,259,737 B2 * 8/2007 Ono et al. ..... 345/82
2006/0061293 A1 * 3/2006 Kobayashi et al. ..... 315/169.3

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner*—Richard Hjerpe
*Assistant Examiner*—Mansour M Said
(74) *Attorney, Agent, or Firm*—Sonnenschein Nath & Rosenthal LLP

(57) ABSTRACT

A scanner repeats a threshold voltage correcting process over a plurality of horizontal periods prior to the sampling of a signal potential to hold a voltage corresponding to the threshold voltage of a driving transistor reliably in a retentive capacitor. Each signal line is associated with a pair of switches, one for supplying the signal potential to the signal line and the other for connecting, to the signal line, a common line for supplying a reference potential. A signal selector turns on and off the switches in each horizontal period in timed relation to a line sequential mode to switch between the signal potential and the reference potential and selectively supply the signal potential and the reference potential to the signal line of each column.

5 Claims, 13 Drawing Sheets

DISPLAY APPARATUS

CROSS REFERENCES TO RELATED APPLICATIONS

The present invention contains subject matter related to Japanese Patent Application JP 2006-306125 filed in the Japan Patent Office on Nov. 13, 2006, the entire contents of which being incorporated herein by reference.

BACKGROUND OF THE INVENTION

1. Field of the Invention

The present invention relates to a display apparatus of the active matrix type comprising light-emitting elements as pixels.

2. Description of the Related Art

In recent years, growing efforts have been made to develop planar self-emission display apparatus comprising organic EL devices as light-emitting elements. The organic EL device is a device which utilizes the phenomenon of light emission from an organic thin film that is placed under an electric field. The organic EL device is of a low power requirement as it can be energized under an applied voltage of 10 V or lower. Furthermore, the organic EL device is a self-emission device capable of emitting light by itself, it requires no illuminating members and can easily be reduced in weight and thickness. The organic EL device produces no image persistence when displaying moving images because it has a very high response rate of about several μs.

Particular efforts have been made to develop active matrix display apparatus comprising integrated thin-film transistors as pixels among the planar self-emission display apparatus comprising organic EL devices as light-emitting elements. Active matrix planar self-emission display apparatus are disclosed in the following patent documents, for example:

Patent Document 1: Japanese Patent Laid-open No. 2003-255856

Patent Document 2: Japanese Patent Laid-open No. 2003-271095

Patent Document 3: Japanese Patent Laid-open No. 2004-133240

Patent Document 4: Japanese Patent Laid-open No. 2004-029791

Patent Document 5: Japanese Patent Laid-open No. 2004-093682

SUMMARY OF THE INVENTION

However, the active matrix planar self-emission display apparatus of the related art are disadvantageous in that transistors for driving the light-emitting elements suffer from threshold voltage and mobility variations due to fabrication process fluctuations. In addition, the organic EL devices have their characteristics tending to vary with time. Such characteristic variations of the driving transistors and characteristic fluctuations of the organic EL devices adversely affect the light emission luminance. For setting the light emission luminance to a uniform level over the entire display surface of the display apparatus, it is necessary to correct the characteristic fluctuations of the transistors and the organic EL devices in respective pixel circuits. There have heretofore been proposed display apparatus having such a characteristic fluctuation correcting function in each pixel. However, pixel circuits of the related art which have the characteristic fluctuation correcting function are complex in structure as they need interconnects for supplying a correcting potential, switching transistors, and switching pulses. Since the pixel circuits are made up of many components, they have presented an obstacle to a high-definition display capability.

It is a general embodiment of the present invention to provide a display apparatus which has a high-definition display capability achieved by simplified pixel circuits.

Another embodiment of the present invention is to provide a display apparatus which is capable of reliably correcting variations of the threshold voltages of driving transistors.

Still another embodiment of the present invention is to provide a display apparatus which is capable of accurately switching between a signal potential and a reference potential on signal lines.

According to an embodiment of the present invention, a display apparatus comprises a pixel array and a driver for driving the pixel array. The pixel array comprises rows of scanning lines, columns of signal lines, a matrix of pixels disposed at crossings of the scanning lines and the signal lines, and feeding lines associated with respective rows of the pixels. The driver comprises a main scanner for scanning the rows of the pixels in a line sequential mode by supplying a control signal successively to the scanning lines in horizontal periods, a power supply scanner for supplying a power supply voltage, which switches between a first potential and a second potential, to the feeding lines in timed relation to the line sequential mode, and a signal selector for selectively supplying a signal potential serving as a video signal and a reference potential to the columns of the signal lines in each of the horizontal periods in the line sequential mode. Each of the pixels comprises a light-emitting element, a sampling transistor, a driving transistor, and a retentive capacitor. The sampling transistor has a gate connected to one of the scanning lines, and a source and a drain, one of which is connected to one of the signal lines and the other to the gate of the driving transistor. The driving transistor has a source and a drain, one of which is connected to the light-emitting element and the other to one of the feeding lines. The retentive capacitor is connected between the source and the gate of the driving transistor. The sampling transistor is rendered conductive in response to a control signal supplied from the scanning line, sampling the signal potential supplied from the signal line and holding the sample signal potential in the retentive capacitor. The driving transistor supplies a drive current to the light-emitting element depending on the signal potential held in the retentive capacitor in response to a current supplied from the feeding line which is under the first potential. The main scanner outputs a control signal for rendering the sampling transistor conductive to perform a threshold voltage correcting process to hold a voltage corresponding to a threshold voltage of the driving transistor in the retentive capacitor during a time interval in which the feeding line is under the first potential and the signal line is under the reference potential. The main scanner repeats the threshold voltage correcting process over a plurality of horizontal periods prior to sampling of the signal potential to hold the voltage corresponding to the threshold voltage of the driving transistor in the retentive capacitor. Each of the signal lines is associated with a pair of switches, one for supplying the signal potential to the signal line and the other for connecting, to the signal line, a common line for supplying the reference potential. The signal selector turns on and off the switches in each of the horizontal periods in timed relation to the line sequential mode to switch between the signal potential and the reference potential and selectively supply the signal potential and the reference potential to the signal line of each column.

According to an embodiment of the present invention, the pixel array is mounted on a single panel, and the switches and the signal selector are mounted on the single panel. The main scanner outputs a control signal to render the sampling transistor conductive to set the gate of the driving transistor to the reference potential and the source thereof to the second potential during a time interval in which the feeding line is under the second potential and the signal line is under the reference potential prior to the threshold voltage correcting process. For rendering the sampling transistor conductive during a time interval in which the signal line is under the signal potential, the main scanner outputs a control signal whose pulse duration is shorter than the time interval to the scanning line thereby to hold the signal potential in the retentive capacitor and simultaneously to add a correction for the mobility of the driving transistor to the signal potential. When the signal potential is held in the retentive capacitor, the main scanner renders the sampling transistor nonconductive to electrically disconnect the gate of the driving transistor from the signal line for thereby allowing the gate potential of the driving transistor to vary as the source potential thereof varies, thereby keeping constant the voltage between the gate and the source of the driving transistor.

According to an embodiment of the present invention, in an active matrix display apparatus wherein light-emitting elements such as organic EL devices are used as pixels, each of the pixels has at least a function to correct the threshold voltage of the driving transistor, and preferably also has a function to correct the mobility of the driving transistor and a function to correct aging-based variations of the organic EL device (bootstrapping operation) for displaying images of high quality. For incorporating those functions, the display apparatus supplies a power supply voltage as switching pulses to the pixels. As the power supply voltage is supplied as switching pulses, the display apparatus does not require switching transistors for correcting the threshold voltage and scanning lines for controlling the gates of the switching transistors. As a result, the number of components making up the pixels and the number of interconnects used are greatly reduced, resulting in a reduction in a pixel area. Accordingly, the display apparatus is allowed to have a high-definition display capability. Heretofore, the pixels with those correcting functions are not suitable for realizing a high-definition display capability due to a large layout area of pixels because the number of components making up the pixels is large. According to the embodiment of the present invention, since the power supply voltage is supplied as switching pulses, the number of components making up the pixels and the number of interconnects used are reduced to reduce the layout area of pixels. The display apparatus can thus be provided as a high-quality, high-definition flat display.

Particularly, according to the embodiment of the present invention, the threshold voltage correcting process is repeated over a plurality of horizontal periods prior to the sampling of the signal potential to hold the voltage corresponding to the threshold voltage of the driving transistor reliably in the retentive capacitor. Since the threshold voltage correcting process is performed a plurality of times, the total correcting time is long enough to hold the voltage corresponding to the threshold voltage of the driving transistor in the retentive capacitor in advance. The voltage corresponding to the threshold voltage of the driving transistor which is held in the retentive capacitor is added to the signal potential sampled in the retentive capacitor, and applied to the gate of the driving transistor. As the voltage corresponding to the threshold voltage of the driving transistor, which is added to the signal potential, cancels the threshold voltage of the driving transistor, it is possible to supply the light-emitting element with a drive current depending on the signal potential without being adversely affected by variations of the threshold voltage. To this end, it is important to held the voltage corresponding to the threshold voltage reliably in the retentive capacitor. According to the embodiment of the present invention, the write time is made sufficiently long by repeatedly writing the voltage corresponding to the threshold voltage in the retentive capacitor a plurality of times. With this arrangement, the display apparatus is capable of suppressing luminance irregularities of displayed images particularly in a low gradation range.

For repeating the threshold voltage correcting process a plurality of times, the potential of each of the signal lines needs to switch between the signal potential and the reference potential in each of the horizontal periods. For switching between the signal potential and the reference potential, each of the signal lines is associated with a pair of switches, one for supplying the signal potential to the signal line and the other for connecting, to the signal line, the common line for supplying the reference potential. According to the embodiment of the present invention, the switches are turned on and off in each horizontal period in timed relation to the line sequential mode to switch between the signal potential and the reference potential and selectively supply the signal potential and the reference potential to the signal line of each column. Since the switches are turned on and off to switch between the signal potential and the reference potential, the potential on the signal line can be changed with accuracy. Even when the potential on the signal line switches between the signal potential and the reference potential in each horizontal period, the signal potential is prevented from being degraded, and the quality of displayed images is maintained at a desired level.

The above and other embodiments, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
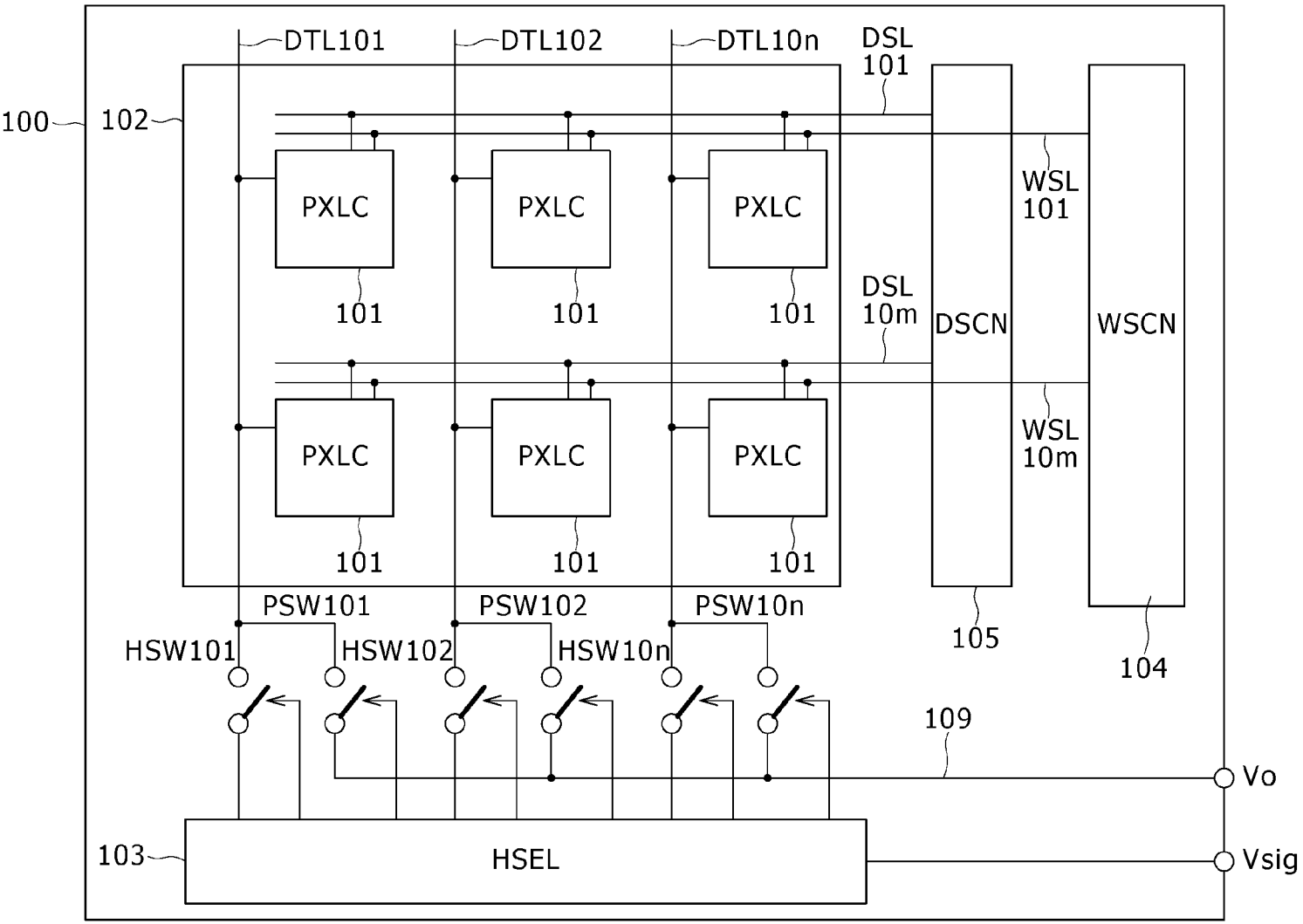
FIG. 1 is a block diagram of a display apparatus according to an embodiment of the present invention.

A display apparatus according to an embodiment of the present invention will be described in detail below with reference to the drawings. FIG. 1 shows in block form the display apparatus according to the embodiment of the present invention. As shown in FIG. 1, the display apparatus, generally designated by 100, comprises a pixel array 102 and a driver (103, 104, 105) for driving the pixel array 102. The pixel array 102 includes rows of scanning lines WSL101 through WSL10*m*, columns of signal lines DTL101 through DTL10*n*, a matrix of pixels (PXLC) 101 disposed at crossings of the scanning lines WSL101 through WSL10*m* and the signal lines DTL101 through DTL10*n*, and feeding lines DSL101 through DSL10*m* associated with respective rows of the pixels 101. The driver includes a main scanner (write scanner WSCN) 104 for scanning the rows of the pixels 101 in a line sequential mode by supplying a control signal successively to the scanning lines WSL101 through WSL10*m* in horizontal periods (1H), a power supply scanner (DSCN) 105 for supplying a power supply voltage, which switches between a first potential (higher potential) and a second potential (lower potential), to the feeding lines DSL101 through DSL10*m* in timed relation to the line sequential mode, and a signal selector (horizontal selector HSEL) 103 for selectively supplying a signal potential serving as a video signal and a reference potential to the columns of the signal lines DTL101 through DTL10*m* in each of the horizontal periods (1H) in the line sequential mode.

According to the embodiment of the present invention, each of the signal lines DTL is connected to a pair of switches HSW, PSW. The switch HSW serves to supply a signal potential serving as a video signal Vsig to the signal line DTL. The switch PSW serves to connect a common line 109 for supplying a referential potential Vo to the signal line DTL. The signal selector 103 alternately turns on the switches HSW, PSW in each horizontal period in timed relation to the line sequential mode of the write scanner 104, for thereby selectively supplying the signal potential serving as the video signal Vsig and the reference potential Vo to the column of the signal line DTL.

According to the present embodiment, the pixel array 102 is constructed on a single panel to construct the display apparatus 100 as a flat panel structure. The switches HSW, PSW, each as many as the number of the signal lines DTL, and the signal selectors 103 for turning on and off the switches HSW, PSW are mounted on the same panel as the pixel array 102. The panel may have terminals for being supplied with the reference potential Vo and the video signal Vsig from an external circuit, and each of the signal lines DTL does not need to be connected to the external circuit. A voltage source for supplying the reference potential Vo and a signal source for supplying the video signal Vsig may be provided as external sources which are of a high driving capability. As the panel is arranged to switch between the reference potential Vo and the signal potential of the video signal Vsig with the switches and selectively supply the reference potential Vo and the signal potential of the video signal Vsig to the signal lines DTL, the signal potential and the reference potential are not degraded and the quality of images displayed by the display apparatus is not impaired. According to the illustrated embodiment, the write scanner 104 and the power supply scanner 105, in addition to the signal selector 103, are also mounted on the same panel as the pixel array 102.

The signal selector 103 basically operates to sample and hold the video signal Vsig supplied from the external circuit in each horizontal period and output the video signal Vsig as sampled and held for each line of pixels. The signal selector 103 thus operates in a line sequential mode to supply the signal potential to the signal lines DTL. However, the display apparatus may employ a point sequential signal driver instead of the signal selector 103. According to the illustrated embodiment, the signal selector 103 turns on and off the switches HSW, PSW at the same time in timed relation to the line sequential mode.

Figure 2:
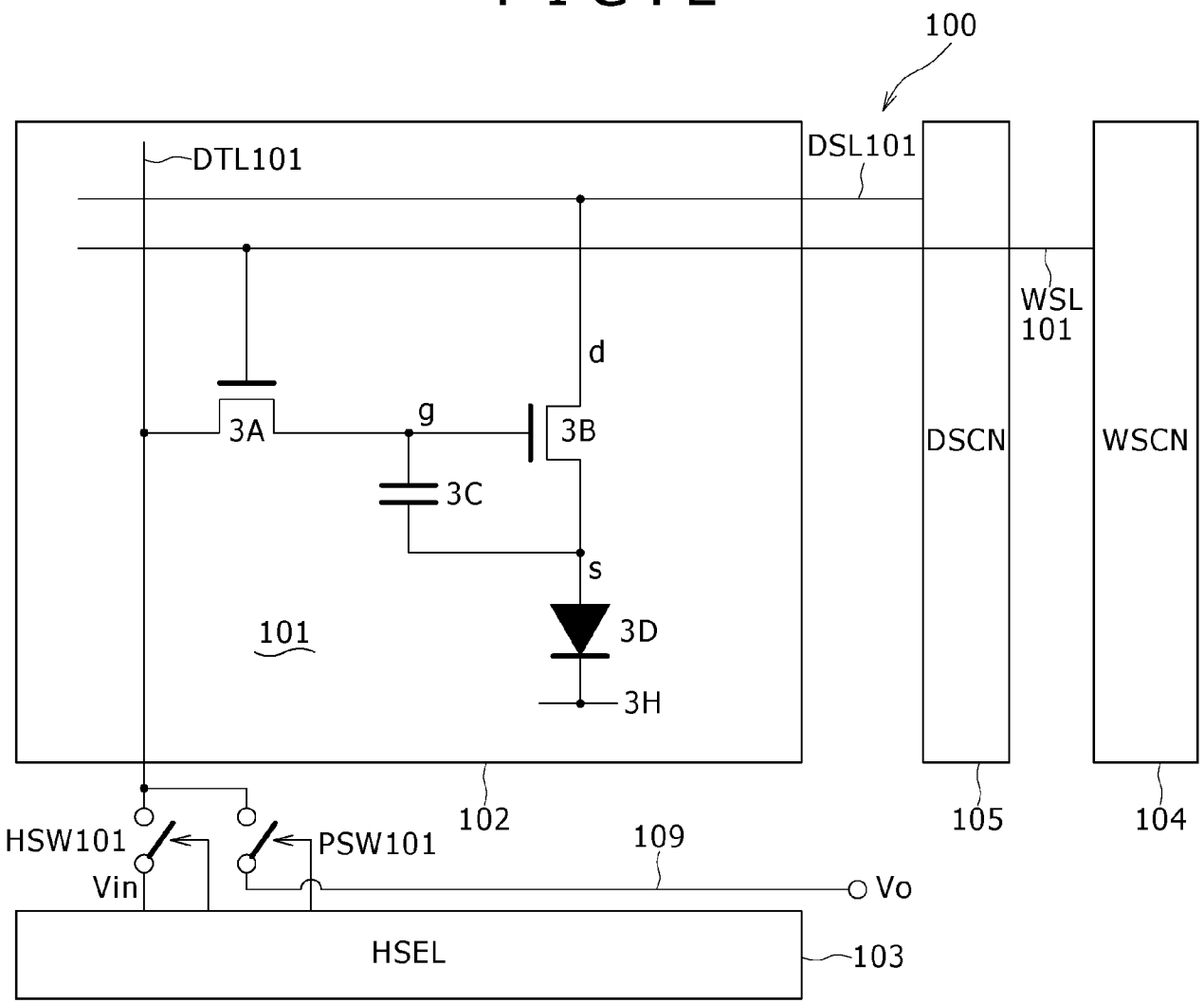
FIG. 2 is a circuit diagram of a pixel circuit included in the display apparatus shown in FIG. 1.

FIG. 2 is a circuit diagram showing specific structural details and interconnections of each pixel 101 included in the display apparatus 100 shown in FIG. 1. As shown in FIG. 2, the pixel 101 comprises a light-emitting element 3D typically comprising an organic EL device, a sampling transistor 3A, a driving transistor 3B, and a retentive capacitor 3C. The sampling transistor 3A has a gate g connected to the corresponding scanning line WSL101 and a source s and a drain d, one of which is connected to the corresponding signal line DTL101 and the other to the gate g of the driving transistor 3B. The driving transistor 3B has a source s and a drain d, one of which is connected to the light-emitting element 3D and the other to the corresponding feeding line DSL101. According to the illustrated embodiment, the drain d of the driving transistor 3B is connected to the feeding line DSL101, and the source s thereof to the anode of the light-emitting element 3D. The cathode of the light-emitting element 3D is connected to a ground interconnect 3H. The ground interconnect 3H is common to all the pixels 101. The retentive capacitor 3C is connected between the source s and gate g of the driving transistor 3B.

The sampling transistor 3A is rendered conductive by a control signal supplied from the scanning line WSL101, sampling the signal potential Vin supplied from the signal line DTL101 and holding the sampled signal potential Vin in the retentive capacitor 3C. When the driving transistor 3B is supplied with a current from the feeding line DSL101 under the first potential, the driving transistor 3B supplies a drive current to the light-emitting element 3D depending on the signal potential held by the retentive capacitor 3C. During a time interval in which the feeding line DSL101 is under the first potential and the signal line DTL101 is under the reference potential Vo, the main scanner 104 outputs a control signal for rendering the sampling transistor 3A conductive to perform a threshold voltage correcting process for holding a voltage corresponding to a threshold voltage Vth for the driving transistor 3B in the retentive capacitor 3C. According to the embodiment of the present invention, the threshold voltage correcting process is repeated in a plurality of horizontal periods prior to the sampling of the signal potential, for reliably holding the voltage corresponding to the threshold voltage Vth for the driving transistor 3B in the retentive capacitor 3C. Since the threshold voltage correcting process is performed a plurality of times, a sufficiently long write time is maintained to reliably hold the voltage corresponding to the threshold voltage Vth for the driving transistor 3B in the retentive capacitor 3C in advance. The retained voltage corresponding to the threshold voltage Vth is used to cancel the threshold voltage Vth for the driving transistor 3B. Even if the threshold voltages for the driving transistors of the respective pixels vary from each other, since they are completely canceled in the respective pixels, the uniformity of images displayed by the display apparatus is increased. In particular, luminance irregularities which tend to appear when the signal voltage represents a low gradation level are prevented from occurring.

For repeating the threshold voltage correcting process, it is necessary to supply the signal line DTLl101 with a potential which switches between the reference potential Vo and the signal potential Vin in each horizontal period. To this end, the signal line DTL101 is connected to a pair of switches HSW101, PSW101. The switch HSW101 serves to supply the signal potential Vin to th signal line DTL101, and the switch PSW101 serves to connect the common line 109 for supplying the reference potential Vo to the signal line DTL101. The signal selector 103 exclusively turns on and off the switches HSW101, PSW101 in each horizontal period in timed relation to the line sequential mode of the write scanner 104, switchingly supplying the signal potential Vin and the reference potential Vo to the signal line DTL101. The pixel circuit 101 can thus repeat the threshold voltage correcting process in a plurality of horizontal periods.

Preferably, prior to the threshold voltage correcting process, the main scanner 104 outputs a control signal to render the sampling transistor 3A conductive to set the gate g of the driving transistor 3B thereby to the reference potential and also to set the source s thereof to the second potential during a time interval in which the feeding line DSL101 is under the second potential and the signal line DTL101 is under the reference potential. With the gate potential and the source potential being thus reset, the subsequent threshold voltage correcting process can reliably be performed.

The pixel 101 shown in FIG. 2 has a mobility correcting function in addition to the threshold voltage correcting function described above. Specifically, when the main scanner 104 outputs a control signal whose pulse duration is shorter than the above time interval to the scanning line WSL101 to hold the signal potential in the retentive capacitor 3C in order to render the sampling transistor 3A during the time interval in which the signal line DTL101 is under the signal potential, the main scanner 104 simultaneously adds a correction for the mobility μ of the driving transistor 3B to the signal potential.

The pixel 101 shown in FIG. 2 also has a bootstrapping function. Specifically, the main scanner (WSCN) 104 cancels the application of the control signal to the scanning line WSL101 when the retentive capacitor 3C holds the signal potential, rendering the sampling transistor 3A nonconductive to electrically disconnect the gate g of the driving transistor 3B from the signal line DTL101. Therefore, the gate potential (Vg) varies as the source potential (Vs) of the driving transistor 3B varies, thereby keeping constant the voltage Vgs between the gate g and the source s.

Figure 3:
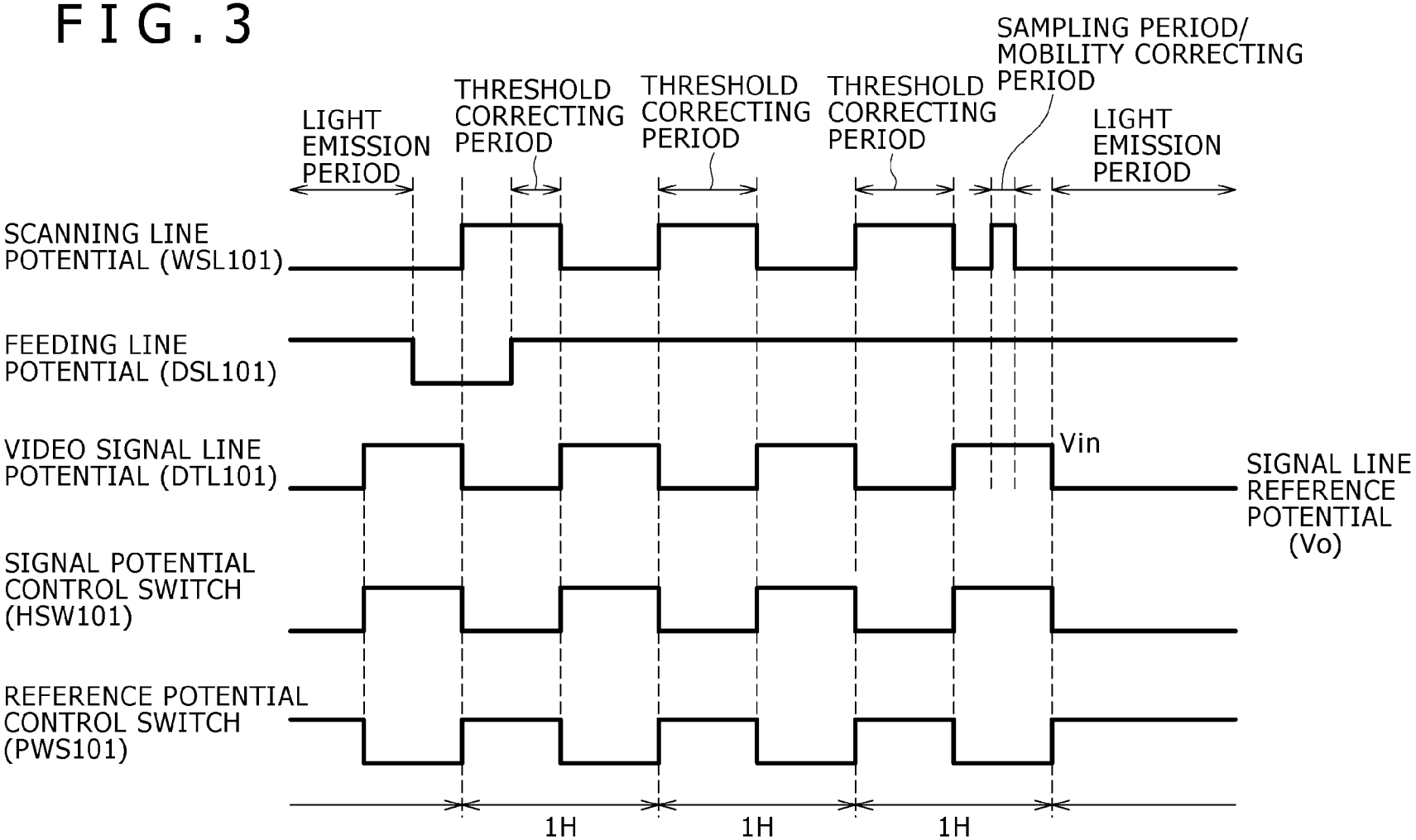
FIG. 3 is a timing chart illustrative of operation of the display apparatus shown in FIG. 1.

FIG. 3 is a timing chart illustrative of operation of the signal selector 103 shown in FIG. 2. The timing chart shows changes in the potential of the scanning line WSL101, the potential of the feeding line DSL101, and the potential of the signal line DTL101 along a common time axis. The timing chart also shows the manner in which the control switch HSW101 for the signal potential and the control switch PSW101 for the reference potential are turned on and off along the common time axis. As shown in FIG. 3, the switches HSW101, PSW101 are repeatedly turned on and off in successive horizontal periods. The potential of the video signal line DTL101 switches alternately between the signal potential Vin and the reference potential Vo in each horizontal period. In FIG. 3, after the light emission period of a preceding field is finished, the threshold voltage correcting process is repeated three times in the next field, after which a sampling process and a mobility correcting process are performed, followed by the light emission period of a subsequent field. The first threshold voltage correcting process is performed when the signal line DTL101 is under the reference potential Vo in the first horizontal period. The second threshold voltage correcting process is performed when the signal line DTL101 is under the reference potential Vo in the second horizontal period. The third threshold voltage correcting process is performed when the signal line DTL101 is under the reference potential Vo in the third horizontal period. In this manner, the threshold voltage correcting process is performed repeatedly in the respective three horizontal periods, thereby writing the potential corresponding to the threshold voltage Vth of the driving transistor 3B reliably in the retentive capacitor 3C. During this time, the potential applied to the video signal line DTL101 switches alternately between the reference potential Vo and the signal potential Vin in each horizontal period as the control switches HSW101, PSW101 are exclusively turned on and off.

Figure 4A:
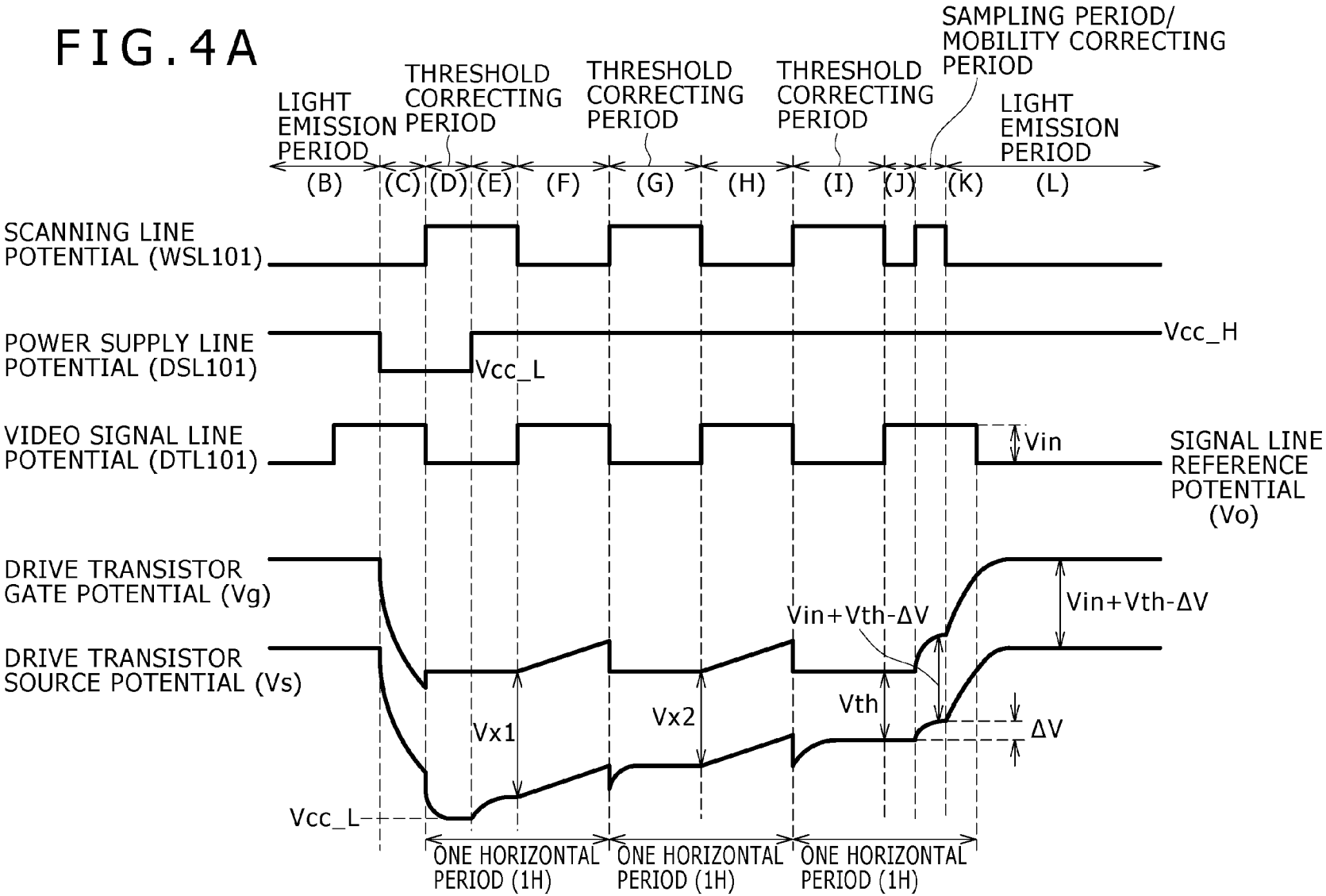
FIG. 4A is a circuit diagram for illustrating operation of the pixel circuit shown in FIG. 2.

FIG. 4A is a circuit diagram for illustrating operation of the pixel 101 shown in FIG. 2. The circuit diagram chart shows changes in the potential of the scanning line WSL101, the potential of the feeding line DSL101, and the potential of the signal line DTL101 along a common time axis. The circuit diagram also shows changes in the gate potential (Vg) and the source potential (Vs) of the driving transistor 3B along with the changes the above potentials.

The circuit diagram shown in FIG. 4A has its time period divided into periods (B) through (L) along the transition of operation of the pixel 101. In the light emission period (B), the light-emitting element 3D is emitting light. Thereafter, in a new field of the line sequential mode, the feeding line DSL101 switches from a higher potential Vcc_H to a lower potential Vcc_L in the first period (C). In the next preparatory period (D), the gate potential Vg of the driving transistor 3B is reset to the reference potential Vo, and the source potential Vs thereof is reset to the lower potential Vcc_L of the feeding line DTL101. Then, the first threshold voltage correcting process is performed in the first threshold correcting period (E). Since the time duration of one threshold voltage correcting process is short, the voltage written in the retentive capacitor 3C is V×1 and does not reach the threshold voltage Vth of the driving transistor 3B.

The transit period (F) after the first threshold correcting period (E) is followed by the second threshold correcting period (G) in the next horizontal period (1H). The second threshold correcting process is now performed, causing the voltage V×2 written in the retentive capacitor 3C to approach the threshold voltage Vth. In the horizontal period (1H) following the next transit period (H), the third threshold correcting process is performed in the third threshold correcting period (I) to cause the voltage written in the retentive capacitor 3C to reach the threshold voltage Vth of the driving transistor 3B.

In a latter part of the final horizontal period, the video signal line DTL101 rises from the reference potential Vo to the signal potential Vin. After the period (J), the signal potential Vin of the video signal is written in the retentive capacitor 3C in addition to the threshold voltage Vth in the sampling period/mobility correcting period (K), and a voltage ΔV for correcting the mobility is subtracted from the voltage held by the retentive capacitor 3C. Thereafter, the light-emitting element 3D emits light at a luminance level dependent on the signal potential Vin in the light emission period (L). Since the signal potential Vin has been adjusted by the voltage corresponding to the threshold voltage Vth and the mobile correcting voltage ΔV, the light emission luminance of the light-emitting element 3D is not affected by variations in the threshold voltage Vth and the mobility μ of the driving transistor 3B. Initially in the light emission period (L), a bootstrapping process is performed to increase the gate potential Vg and the source potential Vs of the driving transistor 3B while the gate-to-source voltage Vgs (=Vin+Vth−ΔV) of the driving transistor 3B is being maintained constant.

The circuit diagram shown in FIG. 4A is illustrates of the threshold voltage correcting process that is repeated three times. Specifically, the threshold voltage correcting process is carried out in each of the periods (E), (G), and (I). The periods (E), (G), and (I) belong to respective former halves of the horizontal periods (1H), and the signal line DTL101 is under the reference potential Vo in these periods. In these periods, the scanning line WSL101 is high in level, turning on the sampling transistor 3A to set the gate potential Vg of the driving transistor 3B to the reference potential Vo. In these periods, the threshold voltage Vth of the driving transistor 3B is corrected. The latter halves of the respective horizontal periods (1H) represent sampling periods for sampling the signal potentials for the pixels of the other rows. In these sampling periods (F) and (H), the scanning line WSL101 are low in level to turn off the sampling transistor 3A. The above operation is repeated to cause the gate-to-source voltage Vgs of the driving transistor 3B to reach the threshold voltage Vth thereof. The number of times that the threshold voltage correcting process is repeated is set to an optimum value depending on the circuit arrangement of the pixel for reliably performing the threshold voltage correcting process. In this manner, a good image quality can be accomplished in a wide gradation range from a black-level low gradation to a white-level high gradation.

Figure 4B:
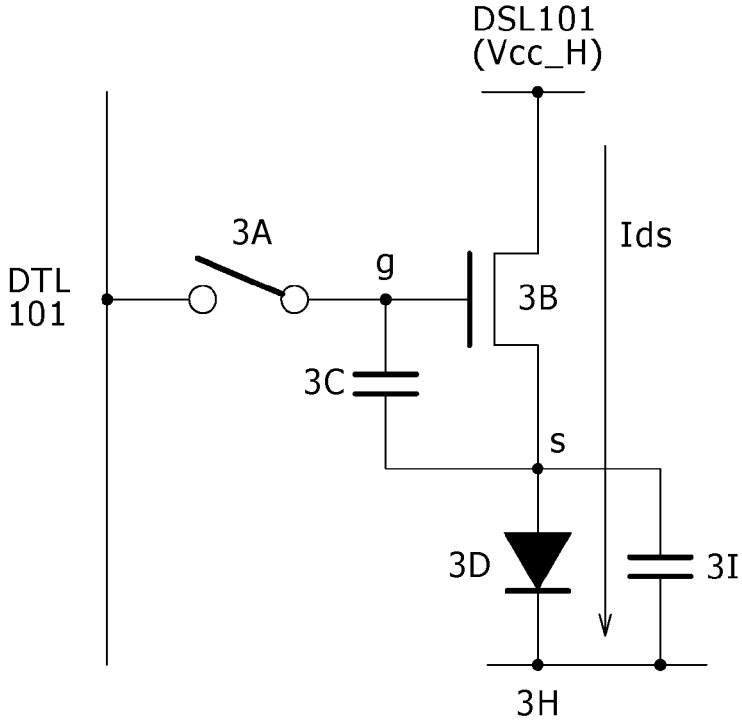
FIG. 4B is a circuit diagram for illustrating operation of the pixel circuit shown in FIG. 2.

The operation of the pixel 101 shown in FIG. 2 will be described in greater detail with reference to FIGS. 4B through 4L. The suffixes B through L of FIGS. 4B through 4L correspond respectively to the periods (B) through (L) in the circuit diagram shown in FIG. 4A. For an easier understanding of the operation, the capacitive component of the light-emitting element 3D is illustrated as a capacitor 3I in FIGS. 4B through 4L. As shown in FIG. 4B, during the light emission period (B), the power supply line DSL101 is under the higher potential Vcc_H (first potential), and the driving transistor 3B supplies a drive current Ids to the light-emitting element 3D. As shown in FIG. 4B, the drive current Ids flows from the power supply line DSL101 under the higher potential Vcc_H through the driving transistor 3B and the light-emitting element 3D into the common ground interconnect 3H.

Figure 4C:
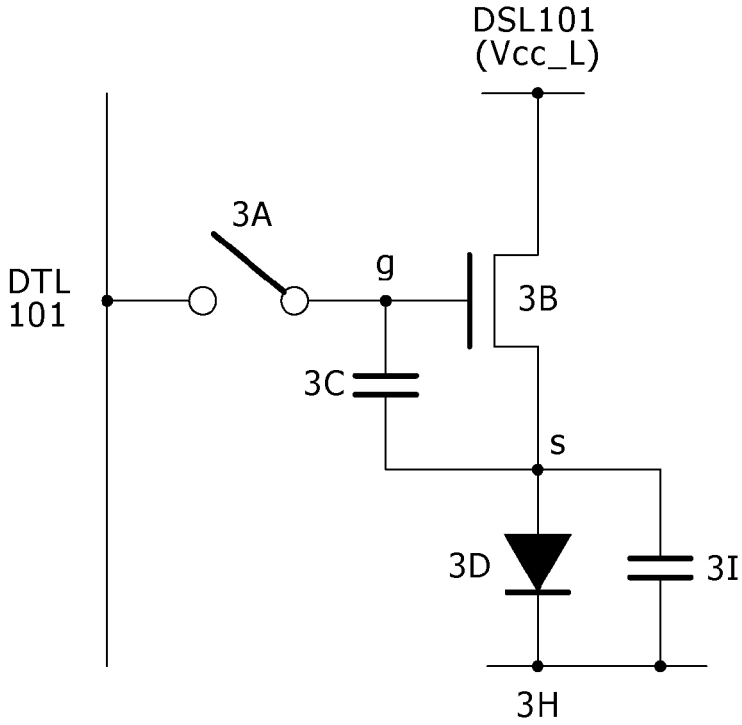
FIG. 4C is circuit diagram for illustrating operation of the pixel circuit shown in FIG. 2.

In the period (C), as shown in FIG. 4C, the power supply line DSL101 is controlled to switch from the higher potential Vcc_H to the lower potential Vcc_L. The power supply line DSL101 is discharged to the lower potential Vcc_L, and the source potential Vs of the driving transistor 3B changes to a potential close to the lower potential Vcc_L. If the interconnect capacitance of the power supply line DSL101 is large, then the power supply line DSL101 may be controlled at a relatively early time to switch from the higher potential Vcc_H to the lower potential Vcc_L. The period (C) is set to a sufficiently long period so as to be free from the effects of the interconnect capacitance and the parasitic capacitance of the pixel.

Figure 4D:
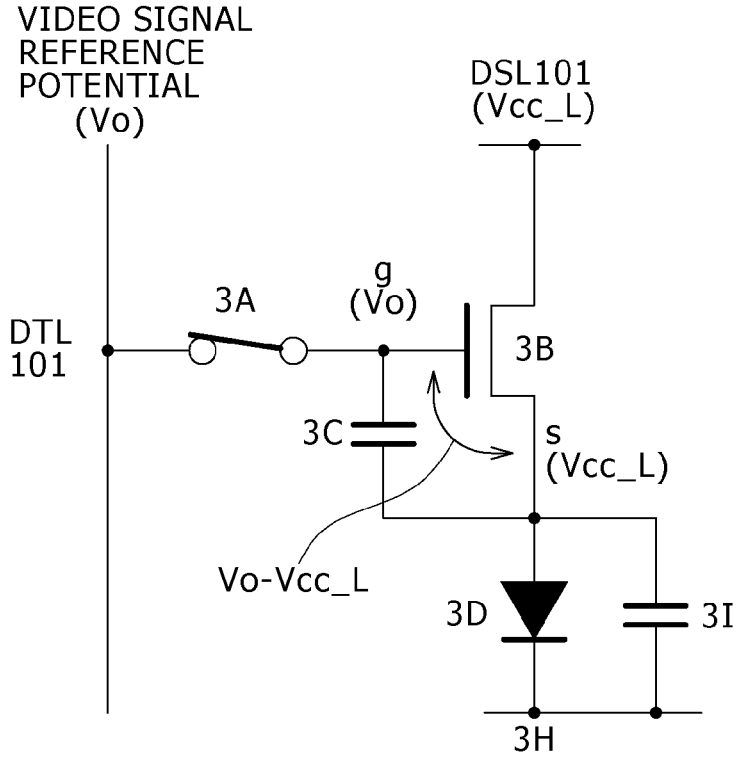
FIG. 4D is a circuit diagram for illustrating operation of the pixel circuit shown in FIG. 2.

In the period (D), as shown in FIG. 4D, the scanning line WSL101 is controlled to switch from the low level to the high level, rendering the sampling transistor 3A conductive. At this time, the video signal line DTL101 is under the reference potential Vo. The gate potential Vg of the driving transistor 3B is equalized to the reference potential Vo of the video signal line DTL101 through the sampling transistor 3A. At the same time, the source potential Vs of the driving transistor 3B is immediately clamped to the lower potential Vcc_L. The source potential Vs of the driving transistor 3B is thus initialized (reset) to the lower potential Vcc_L which is sufficiently lower than the reference potential Vo of the video signal line DTL101. Specifically, the lower potential Vcc_L (second potential) of the power supply line DSL101 is set such that the gate-to-source voltage Vgs (the difference between the gate potential Vg and the source potential Vs) of the driving transistor 3B is higher than the threshold voltage Vth of the driving transistor 3B.

Figure 4E:
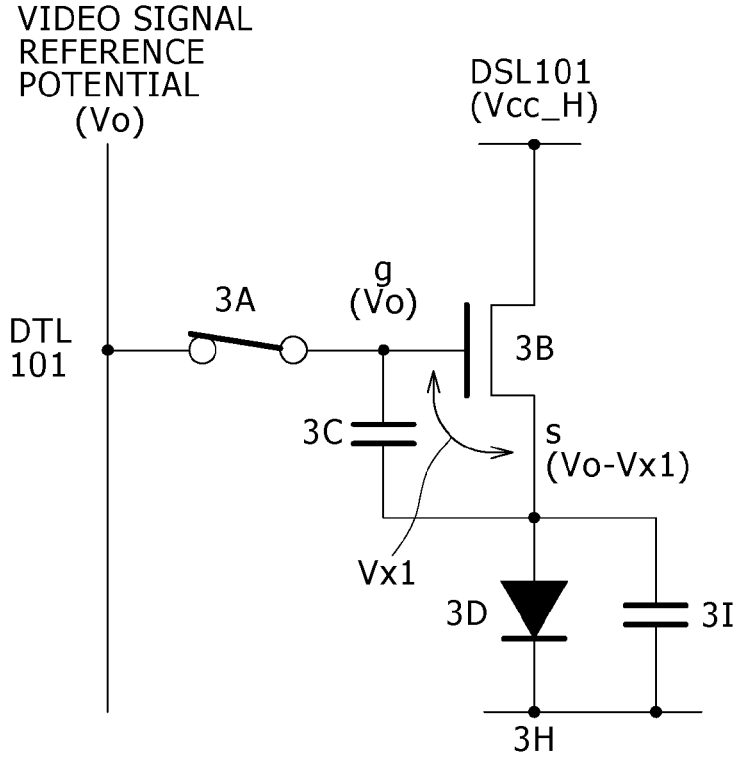
FIG. 4E circuit diagram for illustrating operation of the pixel circuit shown in FIG. 2.

In the first threshold voltage period (E), as shown in FIG. 4E, the potential of the power supply line DSL101 changes from the lower potential Vcc_L to the higher potential Vcc_H, causing the source potential Vs of the driving transistor 3B to start rising. The period (E) terminates at the time when the source potential Vs reaches V×1 from Vcc_L. Therefore, V×1 is written in the retentive capacitor 3C in the first threshold voltage period (E).

Figure 4F:
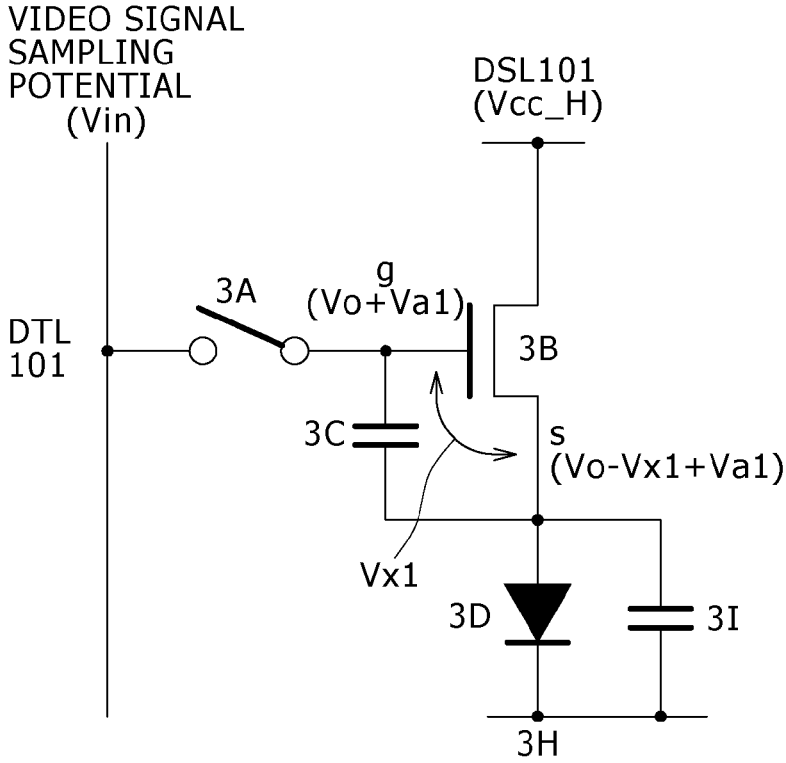
FIG. 4F circuit diagram for illustrating operation of the pixel circuit shown in FIG. 2.

In the latter period (F) of the horizontal period (1H), as shown in FIG. 4F, the video signal line DTL101 changes to the signal potential Vin, and the scanning line WSL101 goes low in level. The period (F) serves as a sampling period for sampling the signal potentials Vin for the pixels of the other rows. Therefore, the sampling transistor 3A of the illustrated pixel needs to be turned off in the period (F).

Figure 4G:
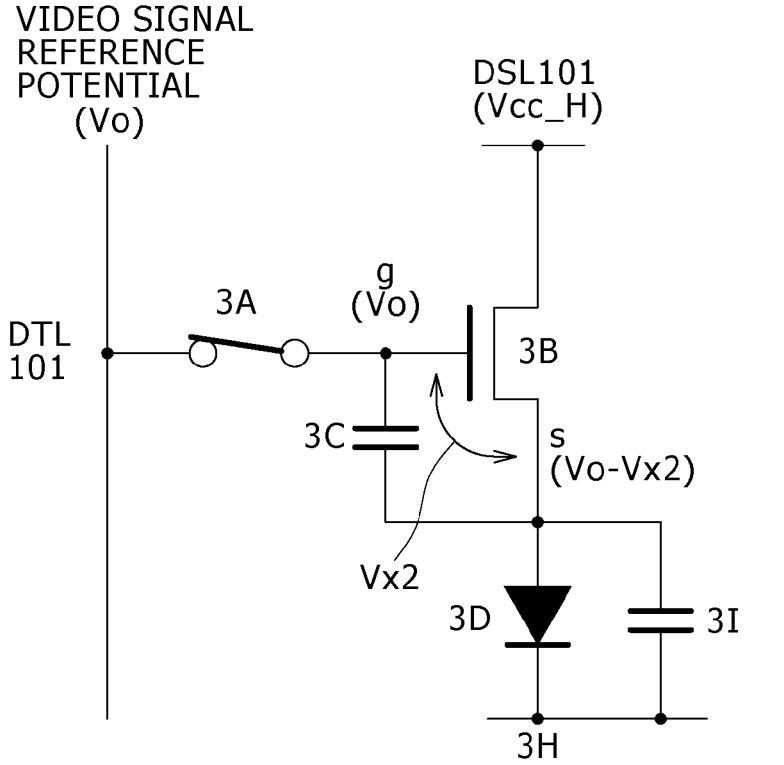
FIG. 4G circuit diagram for illustrating operation of the pixel circuit shown in FIG. 2.

In the former half of the next horizontal period (1H), the second threshold voltage correcting process is performed in the threshold correcting period (G), as shown in FIG. 4G. As with the first threshold voltage correcting process, the video signal line DTL101 is set to the reference potential Vo, and the scanning line VSL101 goes high in level, turning on the sampling transistor 3A. The potential is written in the retentive capacitor 3C until it reaches V×2.

Figure 4H:
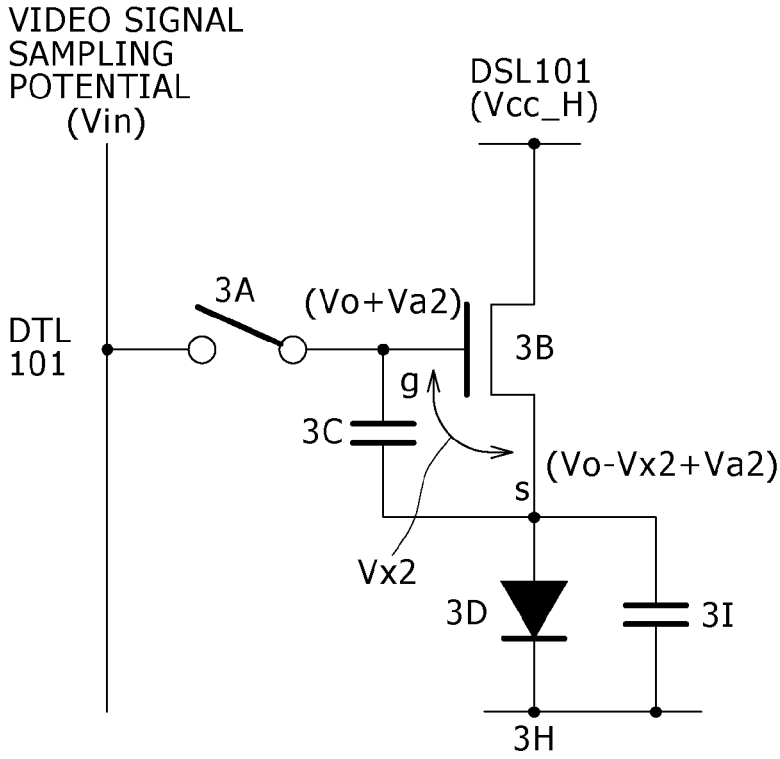
FIG. 4H is a circuit diagram for illustrating operation of the pixel circuit shown in FIG. 2.

In the latter period (H) of the horizontal period (1H), as shown in FIG. 4H, since the signal potentials Vin for the pixels of the other rows are sampled, the scanning line WSL101 goes low in level for the illustrated row, turning off the sampling transistor 3A.

Figure 4I:
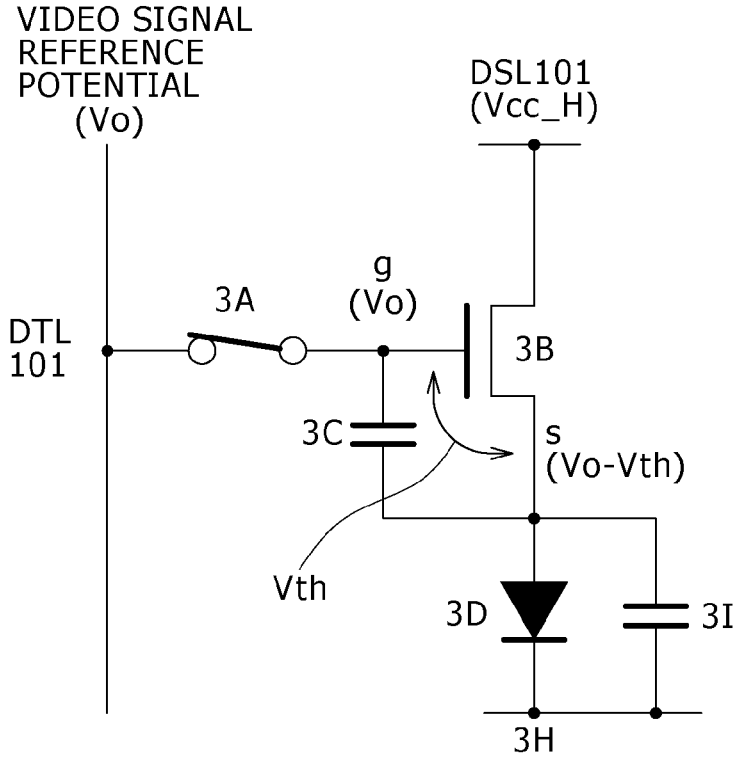
FIG. 4I is a circuit diagram for illustrating operation of the pixel circuit shown in FIG. 2.

In the third threshold voltage correcting process, as shown in FIG. 4I, the scanning line WSL101 goes high in level again, turning on the sampling transistor 3A, and the source potential Vs of the driving transistor 3B starts increasing. The current is cut off when the gate-to-source voltage Vgs of the driving transistor 3B becomes the threshold voltage Vth. In this manner, the voltage corresponding to the threshold voltage Vth of the driving transistor 3B is written in the retentive capacitor 3C. In each of the three threshold correcting periods (E), (G), and (I), the potential of the common ground line 3H is set to cut off the light-emitting element 3D so that the drive current flows into the retentive capacitor 3C only, but not into the light-emitting element 3D.

Figure 4J:
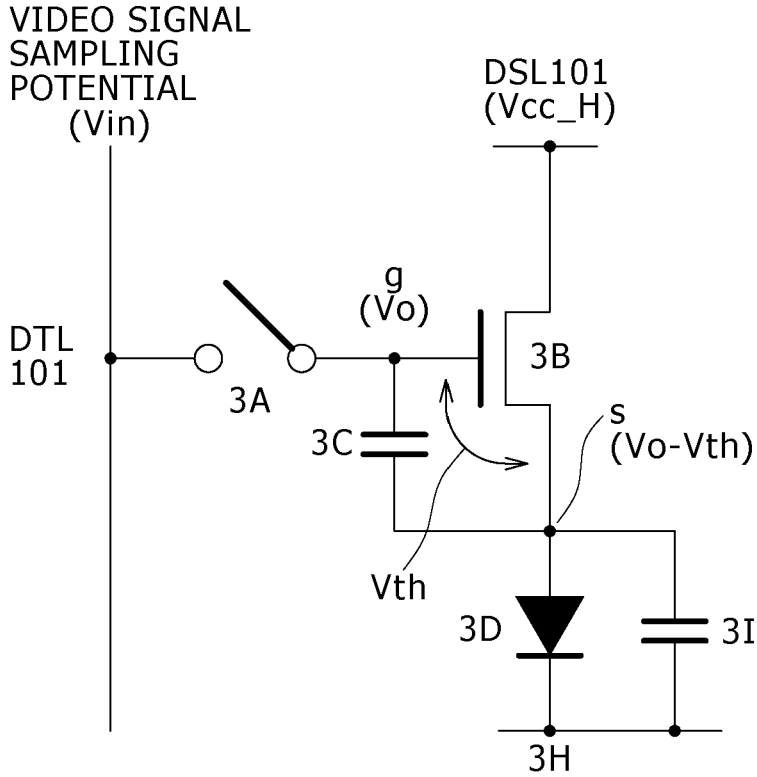
FIG. 4J is a circuit diagram for illustrating operation of the pixel circuit shown in FIG. 2.

In the period (J), as shown in FIG. 4J, the potential of the video signal line DTL101 changes from the reference potential Vo to the sampling potential (signal potential) Vin, completing the preparation for the next sampling operation and mobility correcting operation.

Figure 4K:
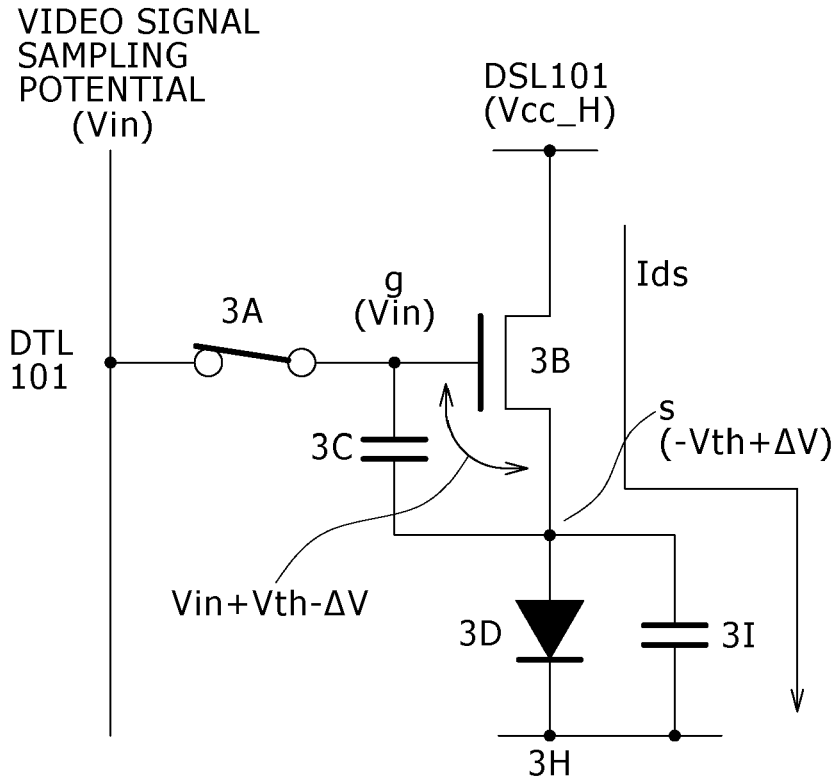
FIG. 4K is a circuit diagram for illustrating operation of the pixel circuit shown in FIG. 2.

In the sampling period/mobility correcting period (K), as shown in FIG. 4K, the scanning line WSL101 changes to the higher potential, turning on the sampling transistor 3A. Therefore, the gate potential Vg of the driving transistor 3B becomes the signal potential Vin. Since the light-emitting element 3D is initially in a cut-off state (high impedance), the drain-to-source current Ids of the driving transistor 3B flows into the light-emitting element capacitor 3I, starting to charge the same. Therefore, the source potential Vs of the driving transistor 3B starts rising until the gate-to-source voltage Vgs of the driving transistor 3B reaches Vin+Vth−ΔV. In this manner, the signal potential Vin is sampled and the corrective quantity ΔV is adjusted at the same time. As Vin is higher, Ids is greater, resulting in a larger absolute value of ΔV. Therefore, the mobility is corrected depending on the light emission luminance level. If Vin is constant, then the absolute value of ΔV is greater as the mobility μ of the driving transistor 3B is greater. Stated otherwise, as the mobility μ is greater, the amount of negative feedback ΔV is greater, so that a variation of the mobility μ of each pixel can be removed.

Figure 4L:
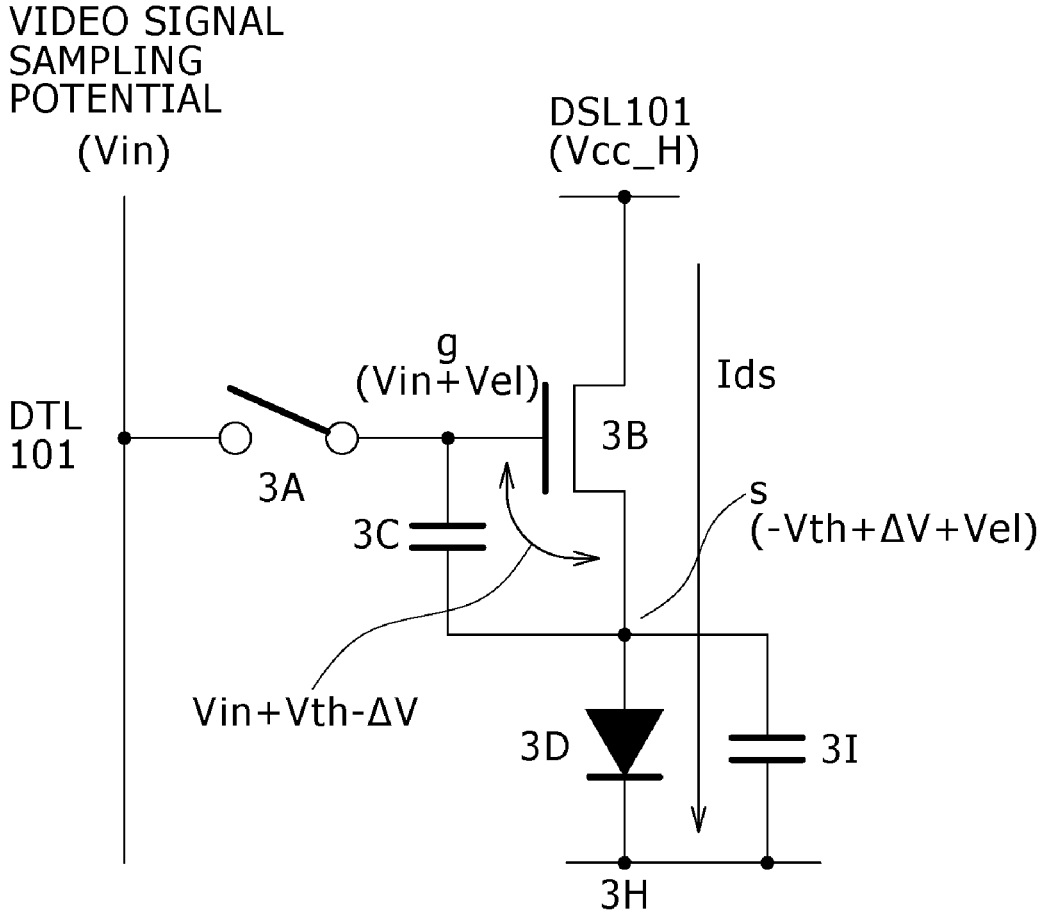
FIG. 4L is a circuit diagram for illustrating operation of the pixel circuit shown in FIG. 2.

Finally in the light emission period (L), as shown in FIG. 4L, the scanning line WSl101 changes to the lower potential, turning off the sampling transistor 3A. Therefore, the gate g of the driving transistor 3B is disconnected from the signal line DTL101. Simultaneously, the drain current Ids starts to flow through the light-emitting element 3D. The anode potential of the light-emitting element 3D increases by Vel depending on the drive current Ids. The increase in the anode potential of the light-emitting element 3D means an increase in the source potential Vs of the driving transistor 3B. As the source potential Vs of the driving transistor 3B increases, the gate potential Vg of the driving transistor 3B also increases because of the bootstrapping action of the retentive capacitor 3C. The increase Vel in the gate potential Vg is equal to the increase Vel in the source potential Vs. Therefore, the gate-to-source voltage Vgs of the driving transistor 3B is maintained at a constant level of Vin+Vth−ΔV during the light emission period.

Figure 5:
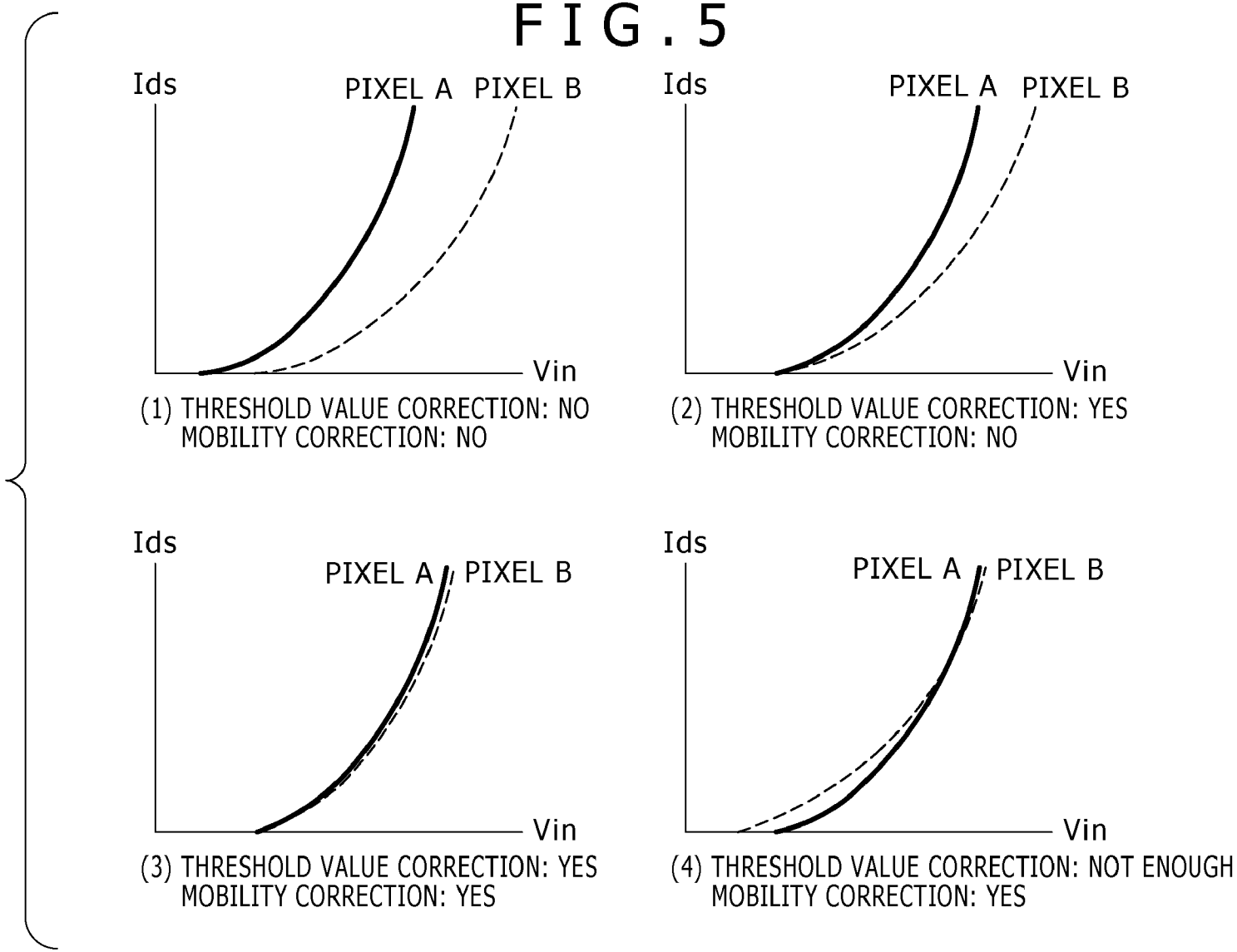
FIG. 5 is a set of graphs illustrative of operation of the display apparatus according to the embodiment of the present invention.

As described above, each of the pixels of the display apparatus according to the embodiment of the present invention has the threshold voltage correcting function and the mobility correcting function. FIG. 5 is a set of graphs (1) through (4) showing current vs. voltage characteristics of the driving transistor included in pixels with those correcting functions. Each of the graphs (1) through (4) has a horizontal axis representing the signal potential Vin and a vertical axis representing the drive current Ids. Each of the graphs (1) through (4) shows the Vin vs. Ids characteristic curves of different pixels A, B. The pixel A has a relatively low threshold voltage Vth and a relatively large mobility μ, and the pixel B has a relatively high threshold voltage Vth and a relatively small mobility μ.

The graph (1) shows the Vin vs. Ids characteristic curves that are plotted when no threshold voltage is corrected and no mobility is corrected. Since the threshold voltage Vth and the mobility μ are not corrected in the pixels A, B, their Vin vs. Ids characteristic curves are widely different from each other because of different values of the threshold voltage Vth and the mobility μ. Even when the same signal potential Vin is given to the pixels A, B, the drive current Ids, i.e., the light emission luminance of the pixels A, B, has different values, resulting in a failure to achieve an image uniformity.

The graph (2) shows the Vin vs. Ids characteristic curves that are plotted when the threshold voltage is corrected and no mobility is corrected. Different values of the threshold voltage Vth are canceled out in the pixels A, B. However, different values of the mobility μ are reflected in the Vin vs. Ids characteristic curves. The different values of the mobility μ manifest themselves in a higher Vth range, i.e., a higher luminance range, resulting in different luminance levels even at the same gradation level. Specifically, at the same gradation level (same Vin), the luminance (drive current Ids) of the pixel A with the greater mobility μ is higher, and the luminance of the pixel B with the smaller mobility μ is lower.

The graph (3) shows the Vin vs. Ids characteristic curves that are plotted when the threshold voltage is corrected and the mobility is corrected according to the embodiment of the present invention. Different values of the threshold voltage Vth and the mobility μ are fully corrected, and hence Vin vs. Ids characteristic curves of the pixels A, B are in agreement with each other. The luminance levels (Ids) of the pixels A, B are the same as each other at all gradation levels (Vin), resulting in a highly improved image uniformity.

The graph (4) shows the Vin vs. Ids characteristic curves of a comparative example that are plotted when the threshold voltage is corrected insufficiently and the mobility is corrected. Stated otherwise, the Vin vs. Ids characteristic curves shown in the graph (4) are plotted when the threshold voltage correcting process is performed only once, rather than being repeated a plurality of times. Since different values of the threshold voltage Vth are not canceled out, different luminance levels (Ids) are produced by the pixels A, B at a low gradation range. If the threshold voltage is corrected insufficiently, therefore, luminance irregularities appear in the low gradation range, impairing the image quality.

Figure 6:
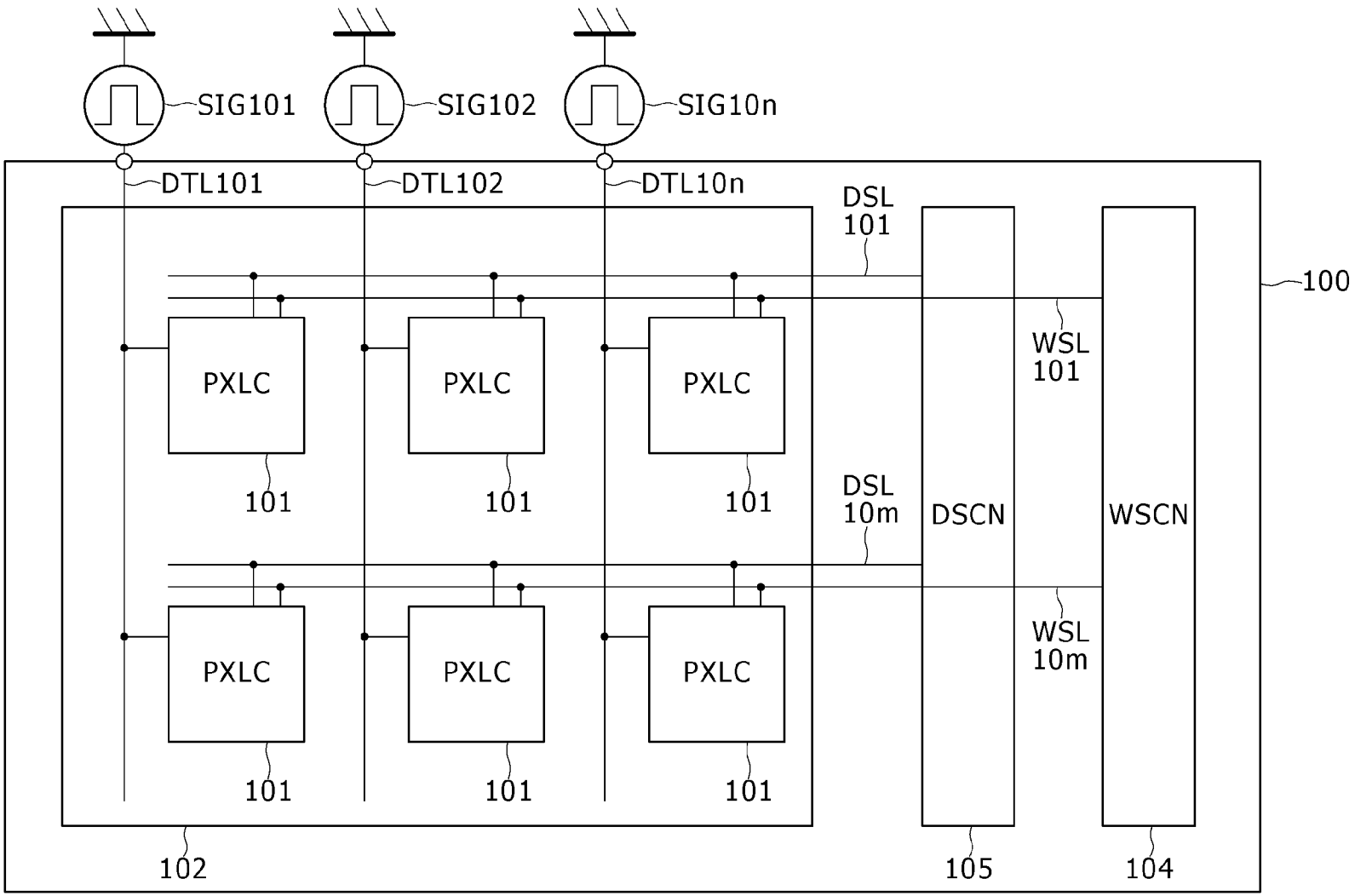
FIG. 6 is a block diagram of a display apparatus according to a comparative example.

FIG. 6 shows in block form a display apparatus according to a comparative example. For an easier understanding of the display apparatus, those parts of the display apparatus shown in FIG. 6 which correspond to those of the display apparatus shown in FIG. 1 are denoted by corresponding reference characters. The display apparatus shown in FIG. 6 is different from the display apparatus shown in FIG. 1 as to a signal supply unit for supplying signals to the signal lines DTL of the pixel array 102. As described above, in order to repeat the threshold voltage correcting process on the pixel circuit 101 over a plurality of horizontal periods, it is necessary to supply pulse signals, which switch alternately between the signal potential and the reference potential, to the signal lines DTL. In the display apparatus shown in FIG. 6, the signal lines DTL are associated with respective pulse signal sources SIG for supplying pulse signals to the signal lines DTL. For example, a first pulse signal source SIG101 is connected to a signal line DTL101 of the first row. The first pulse signal source SIG101 supplies a pulse signal, which switches alternately between the signal potential and the reference potential, to the signal line DTL101. Therefore, the display apparatus shown in FIG. 6 needs as many signal sources DTL as the number of the video signal lines DTL. Consequently, the panel on which the pixel array 102 is mounted requires as many connection pads as the number of the signal lines DTL for connection to the signal sources DTL that are external to the panel. Though television display apparatus having a relatively large panel may be arranged as shown in FIG. 6, it is difficult for small-size display apparatus for use on mobile devices to have an enough space for accommodating such connection pads as the number of the signal lines DTL. In addition, a drive circuit incorporating the signal sources SIG external to the panel is complex in structure.

Figure 7:
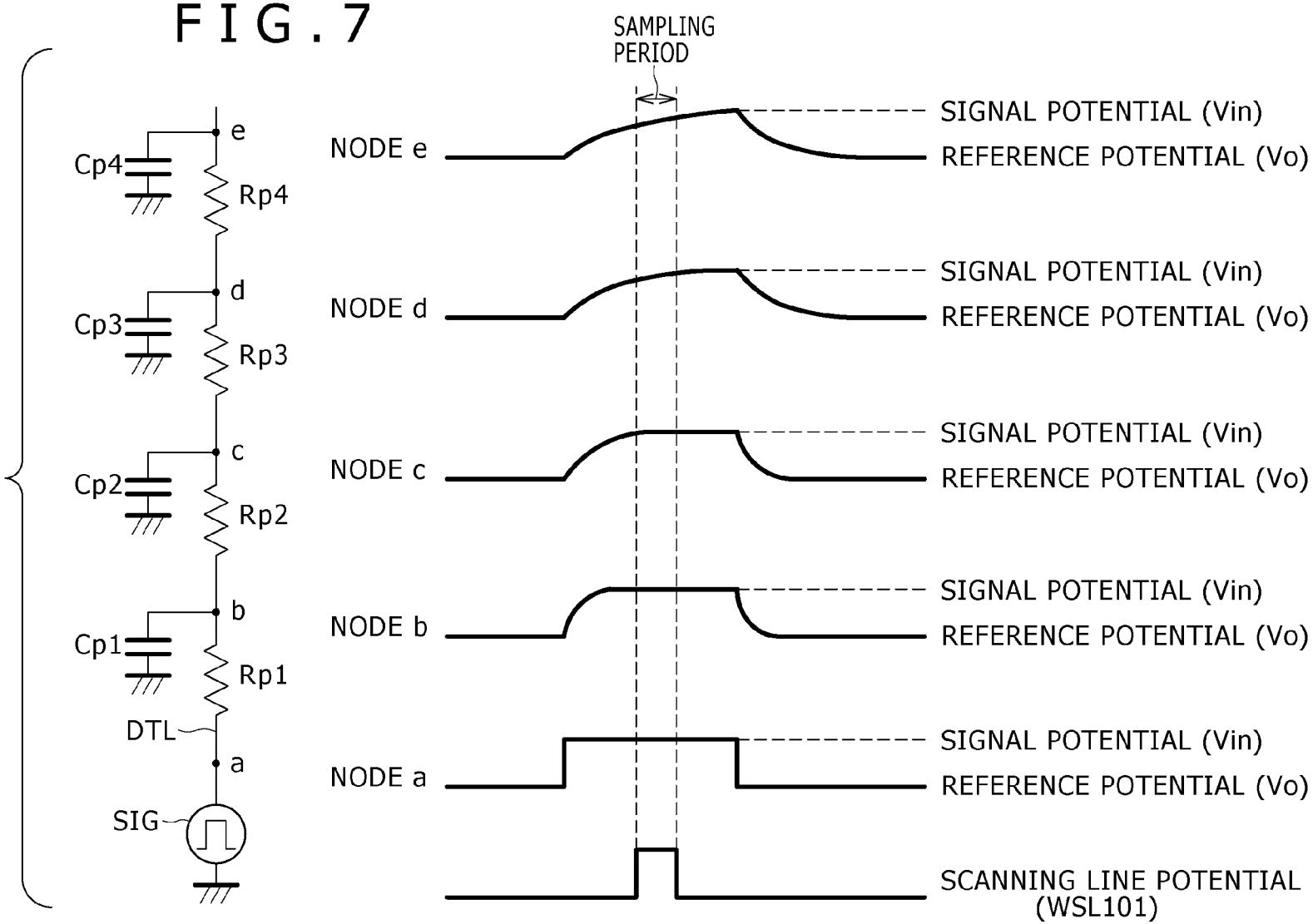
FIG. 7 is a diagram illustrative of operation of the display apparatus shown in FIG. 6.

FIG. 7 is illustrative of operation of the display apparatus shown in FIG. 6. FIG. 7 shows in a left area thereof a single signal line DTL and a pulse signal source SIG connected to the signal line DTL. The signal line DTL is connected to pixels at respective nodes a, b, c, d, e. To each of the nodes, there are added an interconnect resistor Rp and an interconnect capacitor Cp. As shown in FIG. 7, as the distance from the signal source SIG is greater, the accumulated amount of resistance of interconnect resistors Rp and the accumulated amount of capacitance of interconnect capacitors Cp are greater, adversely affecting the pulse signal. Specifically, the pulse signal output from the signal source SIG is degraded by the interconnect resistor and the interconnect capacitor each time the pulse signal passes through a node.

FIG. 7 shows in a right area thereof the waveforms of pulse signals observed at the nodes a, b, c, d, e, respectively. At the node a closest to the signal source SIG, the pulse signal has an essentially rectangular waveform. As the distance from the signal source SIG is greater, the pulse signal is more degraded with its positive- and negative-going edges being more deformed. For example, at the node e, the pulse signal has a blunt positive-going edge, and starts to fall before the signal line changes from the reference potential Vo to the signal potential Vin. This phenomenon prevents the signal potential Vin from being sampled in the retentive capacitor of the corresponding pixel, resulting in a graded image quality. With the display apparatus according to the embodiment of the present invention, however, the signal lines are not associated with the respective independent pulse signal sources, but are combined with switches for selecting a signal potential and a reference potential. Therefore, the pulse signals supplied to the signal lines are not degraded by the interconnect resistance and the interconnect capacitance, so that the display apparatus can display images of good quality.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a pixel array; and a driver for driving said pixel array;

said pixel array including rows of scanning lines, columns of signal lines, a matrix of pixels disposed at crossings of said scanning lines and the signal lines, and feeding lines associated with respective rows of the pixels;

said driver including a main scanner for scanning the rows of the pixels in a line sequential mode by supplying a control signal successively to the scanning lines in horizontal periods, a power supply scanner for supplying a power supply voltage, which switches between a first potential and a second potential, to the feeding lines in timed relation to the line sequential mode, and a signal selector for selectively supplying a signal potential serving as a video signal and a reference potential to the columns of the signal lines in each of the horizontal periods in the line sequential mode;

each of said pixels including a light-emitting element, a sampling transistor, a driving transistor, and a retentive capacitor;

said sampling transistor having a gate connected to one of said scanning lines, and a source and a drain, one of which is connected to one of said signal lines and the other to the gate of the driving transistor;

said driving transistor having a source and a drain, one of which is connected to said light-emitting element and the other to one of said feeding lines;

said retentive capacitor being connected between the source and the gate of the driving transistor;

wherein said sampling transistor is rendered conductive in response to a control signal supplied from the scanning line, sampling the signal potential supplied from the signal line and holding the sample signal potential in the retentive capacitor;

said driving transistor supplies a drive current to said light-emitting element depending on the signal potential held in the retentive capacitor in response to a current supplied from the feeding line which is under said first potential;

said main scanner outputs a control signal for rendering the sampling transistor conductive to perform a threshold voltage correcting process to hold a voltage corresponding to a threshold voltage of said driving transistor in said retentive capacitor during a time interval in which the feeding line is under the first potential and the signal line is under the reference potential;

said main scanner repeats the threshold voltage correcting process over a plurality of horizontal periods prior to sampling of the signal potential to hold the voltage corresponding to the threshold voltage of said driving transistor in said retentive capacitor;

each of said signal lines is associated with a pair of switches, one for supplying the signal potential to the signal line and the other for connecting, to the signal line, a common line for supplying the reference potential; and said signal selector turns on and off said switches in each of the horizontal periods in timed relation to the line sequential mode to switch between the signal potential and said reference potential and selectively supply the signal potential and said reference potential to the signal line of each column.

2. The display apparatus according to claim 1, wherein said pixel array is mounted on a single panel, and said switches and said signal selector are mounted on said single panel.

3. The display apparatus according to claim 1, wherein said main scanner outputs a control signal to render said sampling transistor conductive to set the gate of the driving transistor to said reference potential and the source thereof to said second potential during a time interval in which said feeding line is under the second potential and the signal line is under the reference potential prior to the threshold voltage correcting process.

4. The display apparatus according to claim 1, wherein for rendering said sampling transistor conductive during a time interval in which said signal line is under the signal potential, said main scanner outputs a control signal whose pulse duration is shorter than said time interval to the scanning line thereby to hold the signal potential in said retentive capacitor and simultaneously to add a correction for the mobility of the driving transistor to the signal potential.

5. The display apparatus according to claim 1, wherein when the signal potential is held in said retentive capacitor, said main scanner renders the sampling transistor nonconductive to electrically disconnect the gate of the driving transistor from the signal line for thereby allowing the gate potential of the driving transistor to vary as the source potential thereof varies, thereby keeping constant the voltage between the gate and the source of the driving transistor.

* * * * *